US006494439B1

(12) United States Patent
Collins

(10) Patent No.: US 6,494,439 B1
(45) Date of Patent: Dec. 17, 2002

(54) CARBURETOR CONTROL SYSTEM HAVING TWO CAM MEMBERS CONNECTED TO CHOKE VALVE AND THROTTLE VALVE

(75) Inventor: Imack L. Collins, Fort Mill, NC (US)

(73) Assignee: Homelite Technologies, Ltd., Hamilton (BM)

( * ) Notice: Subject to any disclaimer, the term of this patent is extended or adjusted under 35 U.S.C. 154(b) by 0 days.

(21) Appl. No.: 09/417,562

(22) Filed: Oct. 14, 1999

(51) Int. Cl.[7] ..... F02M 1/02
(52) U.S. Cl. ..... 261/52; 261/64.6
(58) Field of Search ..... 261/52, 64.6

(56) References Cited

U.S. PATENT DOCUMENTS

| | | | | | |
|---|---|---|---|---|---|
| 2,302,527 | A | * | 11/1942 | Coffey | 261/52 X |
| 2,715,522 | A | * | 8/1955 | Carlson et al. | 261/52 X |
| 2,786,657 | A | * | 3/1957 | Sutton | 261/52 X |
| 2,885,194 | A | * | 5/1959 | Winkler | 261/52 |
| 2,982,275 | A | * | 5/1961 | Doman et al. | 261/52 X |
| 3,807,709 | A | * | 4/1974 | Suda et al. | 261/52 X |
| 3,823,700 | A | * | 7/1974 | Gumtow | 261/52 X |
| 3,859,974 | A | * | 1/1975 | Ross | 261/52 X |
| 4,123,480 | A | | 10/1978 | Johansson | 261/52 |
| 4,159,012 | A | | 6/1979 | Pizzuto et al. | 123/65 R |
| 4,200,595 | A | * | 4/1980 | Dye | 261/52 X |
| 4,554,896 | A | | 11/1985 | Songawa | 123/179 G |
| 4,672,929 | A | | 6/1987 | Wissmann et al. | 123/179 G |
| 4,814,114 | A | | 3/1989 | Charmley | 261/35 |
| 4,983,330 | A | | 1/1991 | Harbeke | 261/52 |
| 5,150,673 | A | | 9/1992 | Hoshiba et al. | 123/179.15 |
| 5,200,118 | A | * | 4/1993 | Hermle | 261/64.6 |
| 5,215,049 | A | | 6/1993 | Wolf | 123/179.18 |
| 5,500,159 | A | * | 3/1996 | Martinsson | 261/52 |
| 5,611,312 | A | | 3/1997 | Swanson et al. | 123/436 |
| 5,706,774 | A | | 1/1998 | Shaw | 123/179.11 |
| 5,891,369 | A | * | 4/1999 | Tuggle et al. | 261/52 X |
| 6,000,683 | A | * | 12/1999 | Van Allen | 261/64.6 X |
| 6,202,989 | B1 | * | 3/2001 | Pattullo | 261/64.6 X |

FOREIGN PATENT DOCUMENTS

| | | | | |
|---|---|---|---|---|
| JP | 55-128646 | * | 10/1980 | 261/52 |

* cited by examiner

*Primary Examiner*—Richard L. Chiesa
(74) *Attorney, Agent, or Firm*—Harrington & Smith, LLP

(57) ABSTRACT

A carburetor control system for a carburetor including a first cam and a second cam. The carburetor includes a choke valve assembly and a throttle valve assembly. The first cam is connected to the choke valve assembly. The second cam is connected to the throttle valve assembly. The second cam includes a first section and a second section. When the first cam is moved to a choke position the first section can be contacted by the first cam to latch the second cam in a start position. When the throttle valve assembly is moved to a wide open throttle position the second section can contact the first cam to hold the first cam in the choke position.

23 Claims, 7 Drawing Sheets

CARBURETOR CONTROL SYSTEM HAVING TWO CAM MEMBERS CONNECTED TO CHOKE VALVE AND THROTTLE VALVE

BACKGROUND OF THE INVENTION

1. Field of the Invention

The present invention relates to internal combustion engines and, more particularly, to a carburetor for an internal combustion engine.

2. Prior Art

U.S. Pat. No. 4,123,480 discloses a control mechanism for a carburetor having levers connected to a throttle valve and a choke valve which engage each other. U.S. Pat. No. 4,672,929 discloses an automatic starting arrangement for a carburetor with interacting levers connected to a choke flap and a throttle flap. When the engine is cold it requires a certain amount of enrichment in the air/fuel mixture to operate. It is commonly known to use air flow choking devices or secondary enrichment circuits to provide the required enrichment during cold start. In automotive applications air choking devices were commonly used. In the beginning of the century manually activated systems were used, then thermostatic elements were implemented.

In the field of small two-stroke engines, manual choke devices are widely known. The problem found with this manually activated choke devices is the large number of users that misuse the systems that find themselves flooding the engine. Many attempts have been made to ensure the ease of use of this feature. Some of these attempts require step-by-step actions not followed by many users.

The present invention pertains to a carburetion system similar to those used in portable two-stroke internal combustion engines. The problem to overcome was allowing the enrichment system of the carburetor to operate either in idle or wide open throttle while providing simplicity of operation and low manufacturing cost. The object of the invention, allows the operator to reset the system by releasing the throttle actuator. Prior art systems provide air/fuel mixture enrichment requiring multiple step-by-step sequence of an operator's input. Many times these prior art systems failed to operate properly due to different operator's habits like starting the unit at idle, starting the unit at WOT, not following complicated sequence of steps, not being able to identify proper actuators' positioning, not being able to recognize a "pop" signal, etc. Some prior art throttle-choke linkage system, throttle-choke latching is used to produce fast idle while the enrichment system or choke is activated. Such a system requires a trained operator who is able to learn steps not commonly used by typical users of this equipment. Less than 25% of the population of users starts the engine while at idle position, while the remaining population of users starts the engine at WOT. If not recognized or trained, over 75% of the aforementioned population of users will unintentionally deactivate the system by depressing the throttle actuator to WOT position and the engine will not start.

SUMMARY OF THE INVENTION

In accordance with one embodiment of the present invention, a carburetor control system for a carburetor comprising a first cam and a second cam. The carburetor comprises a choke valve assembly and a throttle valve assembly. The first cam is connected to the choke valve assembly. The second cam is connected to the throttle valve assembly. The second cam comprises a first section and a second section. When the first cam is moved to a choke position the first section can be contacted by the first cam to latch the second cam in a start position. When the throttle valve assembly is moved to a wide open throttle position the second section can contact the first cam to hold the first cam in the choke position.

In accordance with another embodiment of the present invention, a power tool is provided comprising an internal combustion engine which includes a carburetor comprising a choke valve, a first control member connected to the choke valve, a throttle valve, and a second control member connected to the throttle valve. The second control member has two spaced apart contact areas. The first. control member is movable relative to the second control member and, when the first control member and the choke valve are at a choke position, the two spaced apart contact areas can make respective separate contact with the first control member in at least two different positions of the throttle valve.

In accordance with another embodiment of the present invention, a carburetor is provided comprising a housing; a choke valve connected to the housing; a manually actuatable control connected to the choke valve; a first automatic control member connected to the choke valve; a throttle valve connected to the housing; and a second automatic control member connected to the throttle valve. When a user manually moves the manually actuatable control to move the choke valve to a choke position, the first automatic control can contact the second automatic control member to move the throttle valve to a first open position. When the user subsequently moves the throttle valve to a wide open throttle position, the second automatic control member contacts the first automatic control member to provide the choke valve at the choke position.

In accordance with another embodiment of the present invention, a carburetor control system is provided for a carburetor. The carburetor comprises a choke valve, a throttle valve, and a throttle control connected to the throttle valve. A positioning linkage is provided between the choke valve and the throttle valve. When a user moves the choke valve to a choke position the linkage retains the choke valve at the choke position. When the user subsequently moves the throttle control to move the throttle valve to a wide open throttle position, before the throttle valve is released to an idle position, the linkage also locates the choke valve at the choke position.

In accordance with one method of the present invention, a method of setting a carburetor for starting of an internal combustion engine is provided comprising steps of moving a choke valve to a choke position; automatically moving a throttle valve to a partially open position as the choke valve is moved to the choke position; when the throttle valve is moved to the partially open position, latching a first member connected to the choke valve to a second member connected to the throttle valve, wherein the first and second members hold the choke valve in the choke position and the throttle valve in the partially open position; and optionally subsequently moving the throttle valve to a wide open throttle position wherein the second member holds the first member and the choke valve in the choke position, wherein the choke valve can be held at the choke position by the second member when the throttle valve is at either the partially open position or the wide open throttle position.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
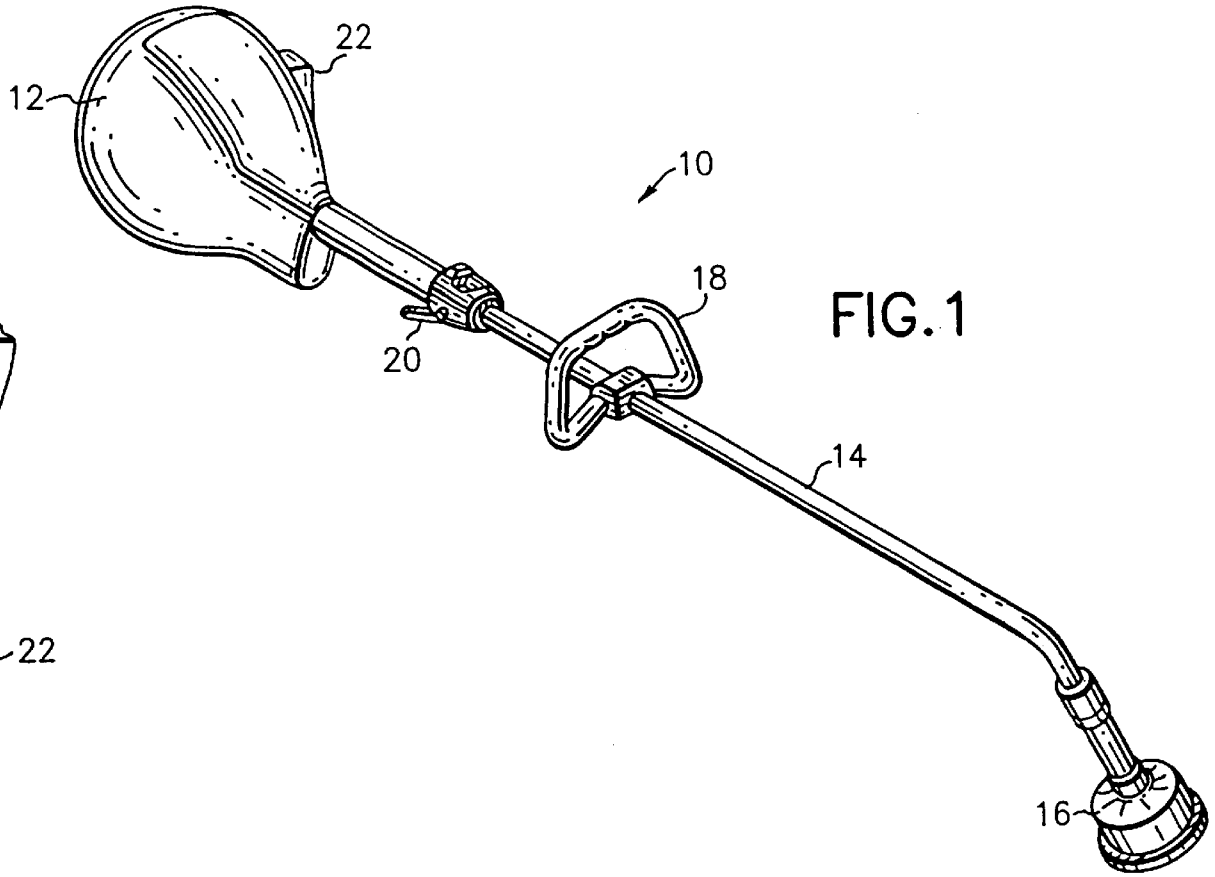
FIG. 1 is a perspective view of a power tool incorporating features of the present invention.

Referring to FIG. 1, there is shown a schematic perspective view of a power tool 10 incorporating features of the present invention. Although the present invention will be described with reference to the single embodiment shown in the drawings, it should be understood that the present invention can be embodied in many alternate forms of embodiments. In addition, any suitable size, shape or type of elements or materials could be used.

Figure 2:
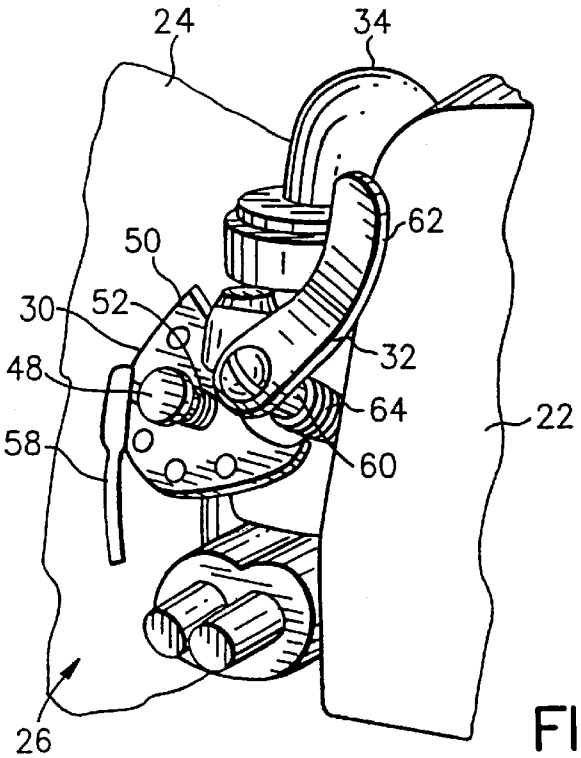
FIG. 2 is a partial perspective view of the front of the carburetor of the tool shown in FIG. 1.
Figure 3:
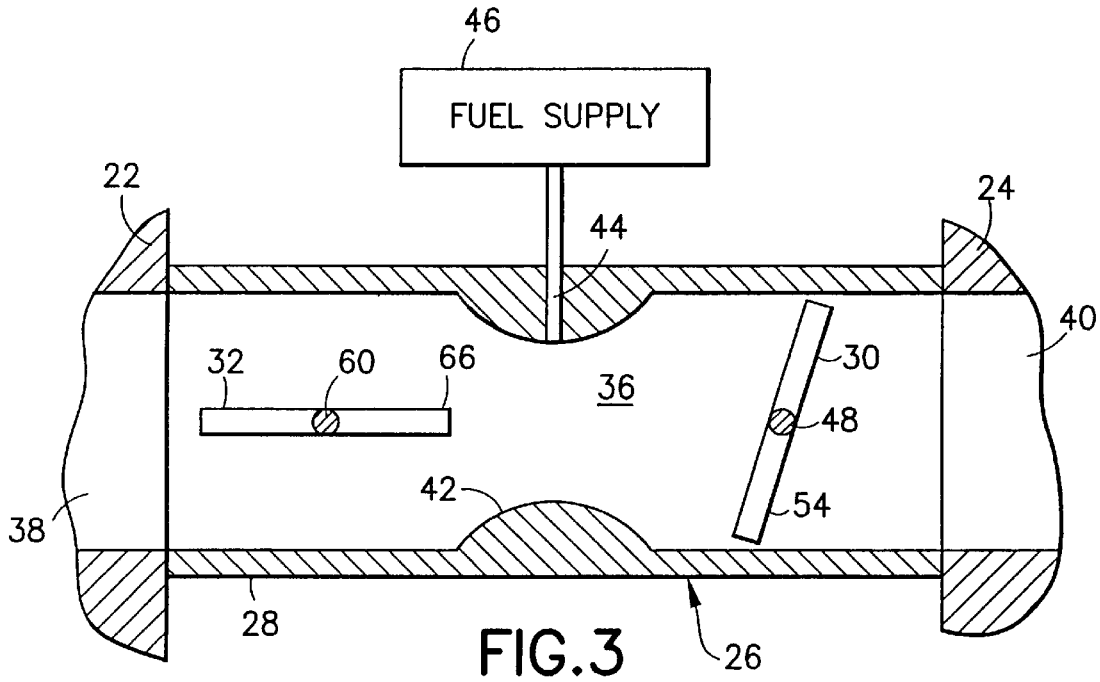
FIG. 3 is a partial schematic cross-sectional view of the carburetor shown in FIG. 2.

The tool 10 is a string trimmer comprising an internal combustion engine 12, a shaft 14, a cutting head 16, a handle 18 and a throttle trigger 20. In alternate embodiments features of the present invention could be used with any suitable type of string trimmer or any suitable type of power tool having an internal combustion engine, such as a hedge trimmer, chain saw, etc. The present invention could also be used with any suitable type of carburetor or internal combustion engine. Referring also to FIG. 2, the engine 12 includes an air filter section 22 connected to the engine block 24 by the carburetor 26. Referring also to FIG. 3, the carburetor 26 includes a frame 28, a throttle valve assembly 30, a choke valve assembly 32, and a primer bulb 34. The frame 28 forms an inlet passage 36 connecting the outlet 38 from the air filter 22 to the inlet 40 into the engine block 24. The frame 28 forms a venturi 42 in the passage 36 and a fuel inlet 44. The fuel inlet 44 is connected to a fuel supply 46 by a suitable fuel metering device as is well known in the art. However, any suitable carburetor frame or fuel delivery system into the carburetor frame could be provided.

Figure 4A:
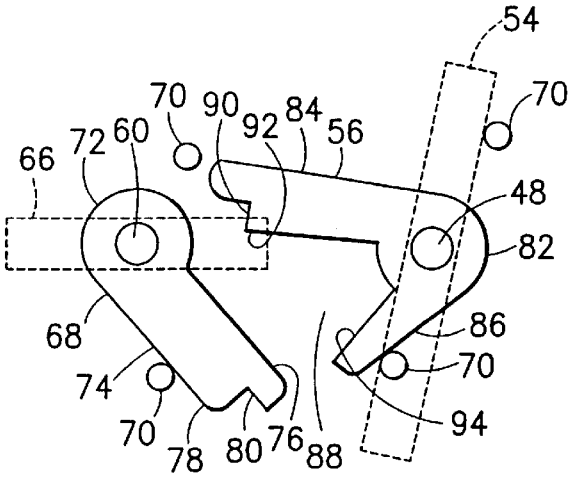
FIGS. 4A–4I are schematic views of the control members of the carburetor shown at different positions.
Figure 4B:
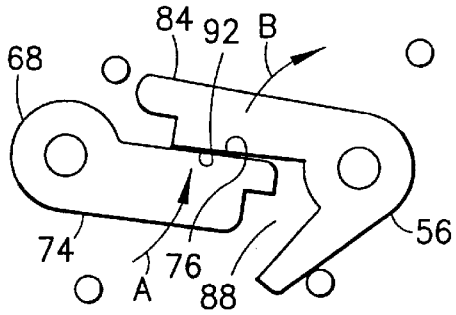
Figure 4C:
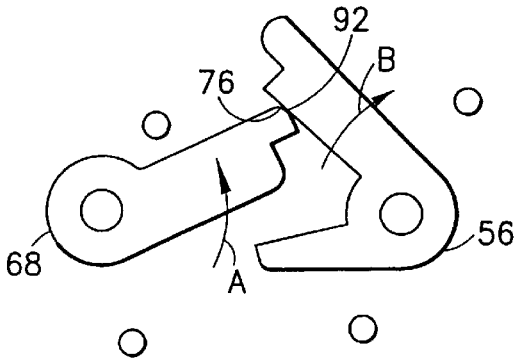

Referring to FIGS. 2, 3 and 4A, the throttle valve assembly 30 generally comprises a throttle shaft 48, a first control member 50, a spring 52, a throttle valve or flap 54, and a second control member 56. The two control members 50, 56 are fixedly connected to the throttle shaft 48 on opposite ends of the shaft; on opposite respective sides of the frame 28. The throttle valve 54 is fixedly connected to the shaft 48 in the passage 36. The first control member 50 is connected to the throttle triggers 20 (see FIG. 1) by a throttle control cable 58. The spring 52 biases the throttle valve assembly 30 towards an idle position.

The choke valve assembly 32 generally comprises a choke shaft 60, a first control member 62, a spring 64, a choke valve or flap 66, and a second control member 68. The two control members 62, 68 are fixedly connected to the choke shaft 60 on opposite ends of the shaft; on opposite respective sides of the frame 28. The choke valve 66 is fixedly connected to the shaft 60 in the passage 36. The spring 64 biases the choke valve assembly 32 in a non-choke position as shown in FIGS. 3 and 4A. The first control member 62 is a user actuated manual lever to move the choke valve 66 to the choke position for starting the engine. In the choke position the ratio of fuel to air is increased because less air from the air filter is allowed to flow into the passage 36 relative to fuel flow into the passage 36. Thus, the choke position or even a partial choke position provides a fuel/air enrichment. A non-choke position does not provide fuel/air enrichment.

Referring now to FIG. 4A, the two second control members or cams 56, 68 are sized and shaped to selectively interact with each other. Stops 70 are shown schematically in FIGS. 4A–4I to show limits to the movements of the two cams 56, 68. The first cam 68 generally comprises a section 72 connected to the choke shaft 60 and an arm 74. The arm 74 generally comprises two contact surfaces 76, 78 on opposite sides of the arm and a latch surface 80 at a distal tip of the arm. When the first cam 68 is in a down position as shown in FIG. 4A, the choke valve 66 is in a non-choke position. The second cam 56 generally comprises a section 82 connected to the throttle shaft 48 and two arms 84,86. The two arms 84,86 extend from the section 82 at different angular positions, such as about 55° apart. However, any suitable angle could be provided. Preferably, the arms 84,86 form a space 88 therebetween. The first arm 84 includes a bottom side cam surface 92 and a latch surface 90 at a distal end of the first arm 84. The second arm 86 includes a top side cam surface 94. When the second cam 56 is in a down position as shown in FIG. 4A the throttle valve 54 is at an idle position.

The two cams 56, 68 help to form a system for positioning the choke valve 66 and the throttle valve 54 for starting the engine. This invention provides a simple enrichment system where only an enrichment lever 62 is moved to an activated position. The activated position is easy to identify because it is spring loaded to the deactivated position. Once the lever is moved to activated position it becomes latched until the throttle actuator 20 is operated. This causes the enrichment lever to be held in position. The action of holding and releasing the throttle actuator 20 is very typical among the spectrum of users of this type of equipment, therefore, once the engine starts, no other unnatural or non-common action of the operator is demanded. The choke is reset by the motion of the throttle actuator 20.

Figure 4D:
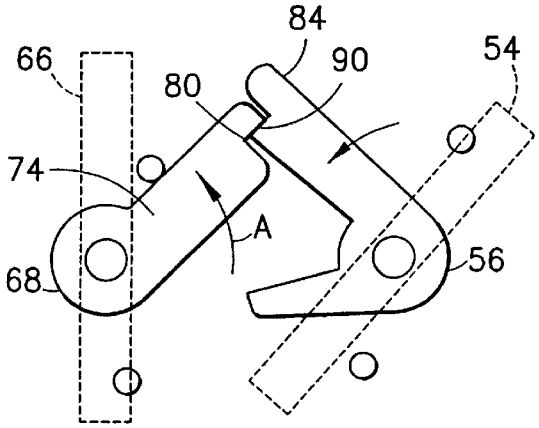

Referring to FIGS. 4A–4D the system will be described when the lever 62 is moved by the user for starting the engine. With the lever 62 in the spring biased deactivated position, the choke valve 66 is in its non-choking open position shown in FIGS. 3 and 4A. As the lever 62 is rotated by the user, the arm 74 is rotated as indicated by arrow A until it reaches its position in FIG. 4D with the choke valve 66 in its choke position. The throttle valve assembly 30 is biased by its spring to bias the second cam 56 in its down/idle position shown in FIG. 4A. However, as the first cam 68 rotates in direction A, the arm 74 moves through space 88, and contacts arm 84. More specifically, the contact surface 76 contacts the cam surface 92 and cams the arm upward as indicated by arrow B. The camming action between the two arms 74, 84 stops when the two latch surfaces 80,90 latch with each other as shown in FIG. 4D. The user can now release the lever 62 and the choke valve assembly 32 will be retained at the choke position because of the latching engagement with the arm 84. The throttle valve assembly 30, because of the camming action of the arm 74 against the arm 84, has had its valve 54 moved to a partially open start position as seen in comparing FIG. 4A to FIG. 4D. The throttle valve assembly 30 will be retained at this partially open start position because of the latching engagement of the arm 84 against the arm 74. Thus, the two valve assemblies 30, 32 are positioned at a first position for starting the engine. The user can pull the starter cord or activate an electric starter to start the engine. As noted in the prior art section above, some users (about 25%) start portable two-stroke engines while the throttle is at the idle position; i.e.: without the user depressing the throttle trigger to a wide open throttle position. The present invention accommodates this percentage of the population of users by positioning the valve assemblies 30,32 at the first start position shown in FIG. 4D without the throttle trigger 20 being depressed.

Figure 4E:
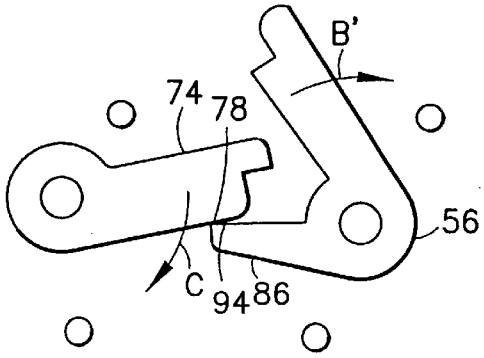
Figure 4F:
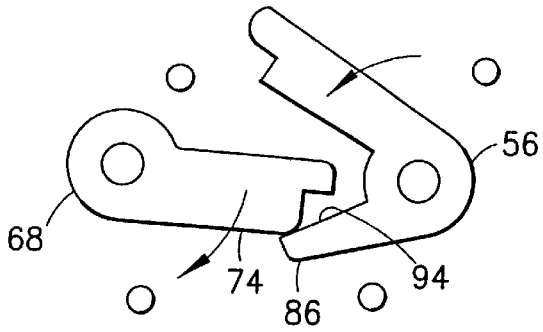
Figure 4G:
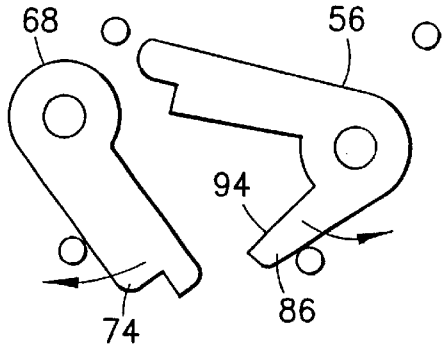
Figure 4H:
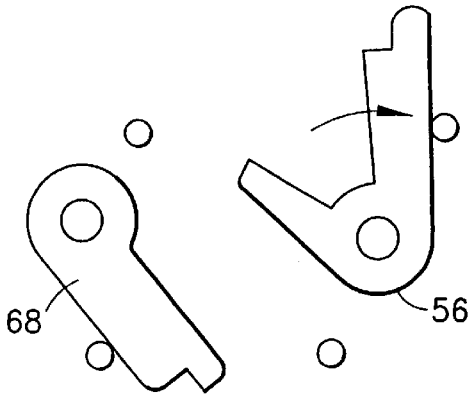
Figure 4I:
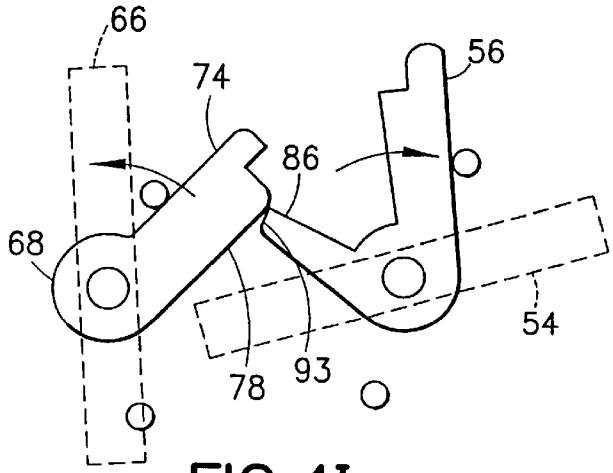

Once the engine starts the user will then depress the throttle trigger 20 to move the throttle valve assembly 30 and its cam 56 as indicated by arrow B' in FIG. 4E. As the second cam 56 is rotated in direction B' the latching engagement at latching surfaces 80 and 90 disengage. The choke valve assembly spring 64 biases the choke valve assembly 32 and its cam 68 in direction C (opposite direction A) back towards its non-choking open position. However, the lower arm 86 of the second cam 56 is in the path of the arm 74. Thus, after the two latching surfaces 80,90 separate, the arm 74 moves through space 88 until the contact surface 78 contacts the cam surface 94. The user can then release the throttle trigger 20. The throttle valve assembly spring 52 then biases the throttle valve assembly 30 back to its idle position with the cams 56,68 moving as indicated by FIGS. 4F and 4G. As the lower arm 86 moves down, the arm 74 slides off the cam surface 94 to totally disengage the two cam 56, 68 from each other. The user is now free to depress and release the throttle trigger 20 to move the throttle valve assembly 30 between its idle position and its wide open throttle position without the two cams 56, 68 interacting with each other. Thus, as illustrated by FIGS. 4G and 4H, the second cam 56 can move between an idle position (FIG. 4G) and a wide open throttle position (FIG. 4H) without the first cam 68 being moved; thereby not moving the choke valve assembly 32 from its non-choking open position.

As noted above in the prior art section, some users (about 75%) start portable two-stroke engines while the throttle is at the wide open throttle position; i.e.: they depress the throttle trigger 20 when starting the engine. The control system of the present invention is also configured to accommodate these types of users. These second type of users would manually move the choke valve assembly control lever 62 (see FIG. 2) to its choke position with the two control cams 56,68 moving as indicated in FIGS. 4A–4D. However, before starting the engine the second type of user would then depress the throttle trigger 20 to move the second cam 56 from the position shown in FIG. 4D, through the position shown in FIG. 4E, to the wide open throttle position shown in FIG. 4I. As the second cam 56 is moved away from the latched position shown in FIG. 4D, the two latching surfaces 80,90 disengage with the arm 74 falling onto the lower arm 86 as seen in 4E. As the second cam 56 is rotated to the wide open throttle position shown in FIG. 4I, the lower arm 86 moves the arm 74 and the choke assembly to its choke position. The choke valve 66 is located at its choke position and the throttle valve 54 is located at its wide open throttle position. Once the engine starts, the user then releases the throttle trigger 20, wherein the two cams move to their positions shown in FIG. 4G; through their positions shown in FIG. 4F.

The system of the present invention uses two cams to synchronize the position of the choke shaft in relation with the throttle shaft and to perform the required functions. One cam is attached to the choke shaft and the other to the throttle shaft respectively. Both shafts are spring loaded in a counterrotating position. In a deactivated position, the throttle shaft cam is at its rest position. At this position the air flow entering the carburetor is unrestricted by the choke plate which is positioned with its flat surface parallel to the air flow direction. While the choke cam is in its deactivated position, the throttle cam is free to rotate. This allows the control of the various engine speeds during normal operation.

The method described by this invention, uses a manually activated enrichment system which is automatically disengaged when the operator releases the throttle actuator. To provide this function, the choke shaft must be manually moved towards the activated position biasing the spring force forcing it to rest or deactivated position. The rotation of the choke shaft positions the choke plate in such a way to restrict the air flow entering the carburetor, therefore providing air-fuel enrichment. The identification of the activated or deactivated choke position is besides visually obvious, also mechanically evident. It is spring loaded against a stop point at its deactivated position, and it is latched in the activated position.

While the choke lever is being moved to the activated position, the choke cam pushes against a face of the choke cam away from the throttle shaft axis. The driving force of the choke cam biases the spring force acting over the throttle shaft forcing it to the idle position; producing rotation towards the opening position of the throttle valve. The rotation of the throttle shaft stops when the choke cam or choke assembly touches a stop at the end if its travel. Once at the end of its travel, the choke shaft becomes latched with the throttle cam which has an engaging feature that holds the choke cam at that position. When the choke shaft is latched by the throttle shaft, the rotation of the throttle shaft produces a partial opening of the throttle valve. Under this condition, the choke valve is fully applied and the partial opening of the throttle plate produces a fast idle, the engine can then be started.

If the operator falls into the group with the habit of holding the throttle valve fully open, while the choke is applied, the system operates in the same mode. This is attained by the action of the throttle cam driving the choke cam to fully activated position. Further rotation of the throttle shaft, while the choke cam is latched in activated position, unlatches the choke cam, then another element of the throttle cam catches the choke cam and forces its travel to the fully activated position. The choke cam will remain at the fully activated position while the throttle is held to its fully open position. Once the operator releases the throttle control, the throttle cam moves to idle position being followed by the choke cam. At idle position the throttle cam allows the choke cam to disengage and travel to its fully deactivated position. Afterwards the engine will work without enrichment at normal operating conditions.

The present invention provides a simple and user obvious one-lever, one way enrichment control which will operate well under a very wide spectrum of users with different habits. The present invention takes advantage of users' habits to perform proper functions. No complicated user starting steps are needed; instead only a one-time initial starting control is moved. The present invention can also be provided at a low cost during manufacturing.

Figure 5:
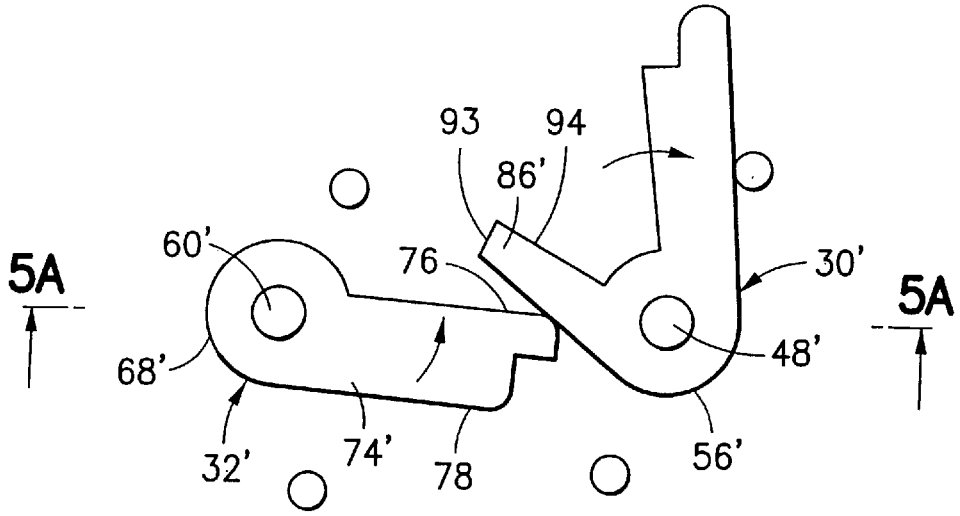
FIG. 5 is a schematic view of the control members of an alternate embodiment of the present invention.
Figure 5A:
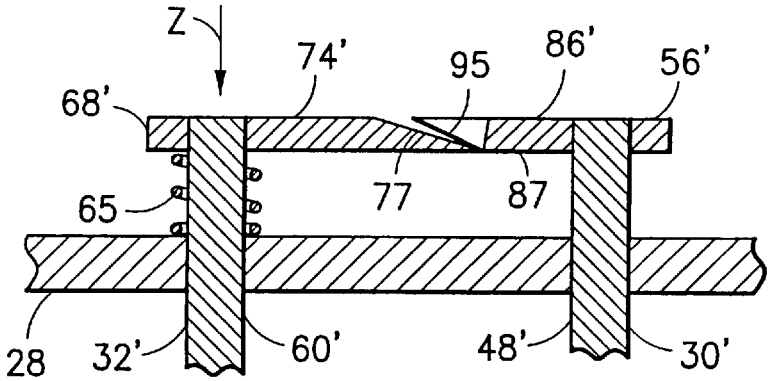
FIG. 5A is a cross-sectional view taken along line 5A—5A of FIG. 5.
Figure 5B:
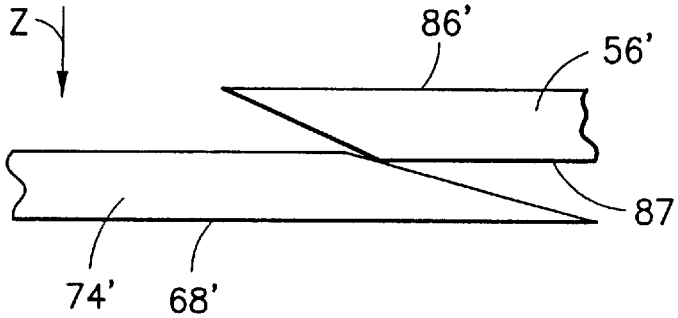
FIG. 5B is an enlarged view of the two control members shown in FIG. 5A moving later ally past each other.

It has also been discovered that a group of users might actuate the throttle to a wide open throttle position and then try to move the choke valve assembly to the choke position. This could cause a problem because the arm 86 of the second cam 56 could block the arm 74 of the first cam 68. Thus, the choke valve assembly 32 could be prevented from being moved to the full choke position if the user first moves the throttle valve assembly 30 to the wide open throttle position. One solution to this potential problem is shown in FIGS. 5, 5A and 5B. In this embodiment the choke valve assembly 32' has a shaft 60' that is longitudinally movably connected to the frame 28. The first control member 68' is fixedly connected to the shaft 60'. A spring 65 is connected to the shaft 60' to bias the first control member 68' in an outward direction from the frame 28. In this embodiment the first control member 68' includes a cam surface 77 on the outside side between and generally orthogonal to surfaces 76 and 78. The throttle valve assembly 30' includes the shaft 48' and the second control member 56'. The second control member 56' is fixedly connected to the shaft 48'. In this embodiment the arm 86' of the second control member 56' includes a cam surface 95 on an inside side 87 generally orthogonal to the surface 94. The two cam surfaces 77, 95 have general wedge shapes and are adapted to engage each other in a situation such as described above when a user first moves the throttle valve assembly to a wide open throttle position and then attempts to move the choke valve assembly to its full choke position. However, the system shown in FIGS. 5, 5A and 5B allows the arm 74' to move past the arm 86' to the position similar to that shown in FIG. 4I with the surfaces 78 and 93 engaging each other. As seen in FIGS. 5A and 5B, the first control member 68' is able to move in direction Z relative to the second control member 56' with the spring 65 being compressed between the first control member 68' and the frame 28. Thus, the arm 74' is able to pass along the inside surface 87 of the arm 86'. When the two arms 74' and 86' reach a position similar to that shown in FIG. 4I, the arm 74' snaps back into the same plane as arm 86' (reverse to direction Z) and the surfaces 78 and 93 engage each other. This automatically overcomes the potential problem noted above. In an alternate embodiment the throttle shaft assembly 30' could be movable in direction Z. Alternatively, the members 68' or 56' could be configured to move in a direction reverse to Z when they engage each other. Alternate biasing means and cam configurations could also be provided.

Figure 6:
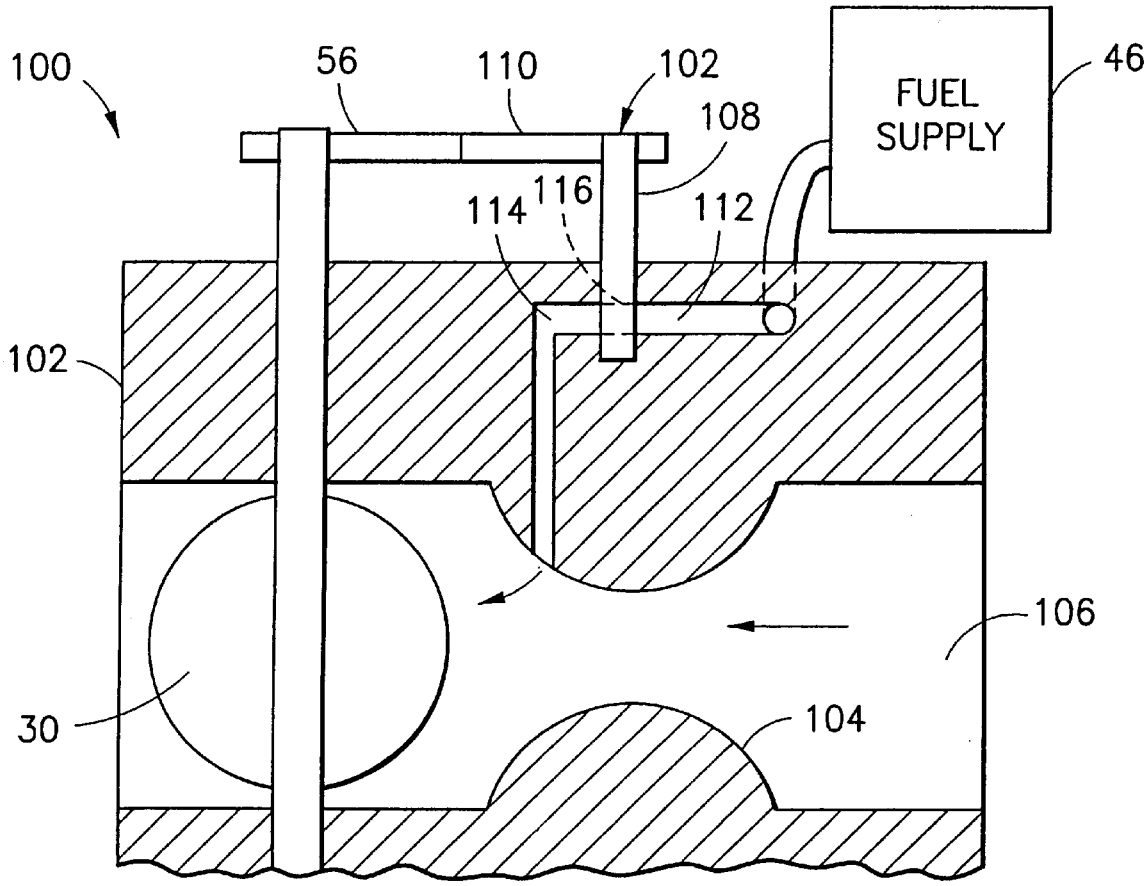
FIG. 6 is a schema tic cross-sectional view of another alternate embodiment of the present invention.
Figure 7A:
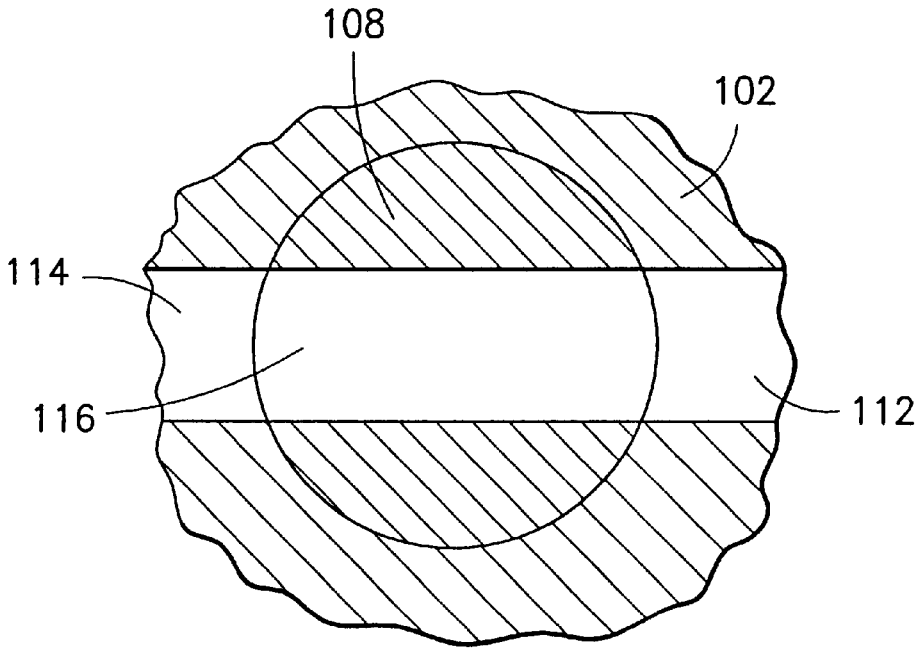
FIG. 7A is an enlarged cross-sectional view of the shaft and frame of the fuel enrichment system shown in FIG. 6 with the shaft i n a fuel/air enrichment position.
Figure 7B:
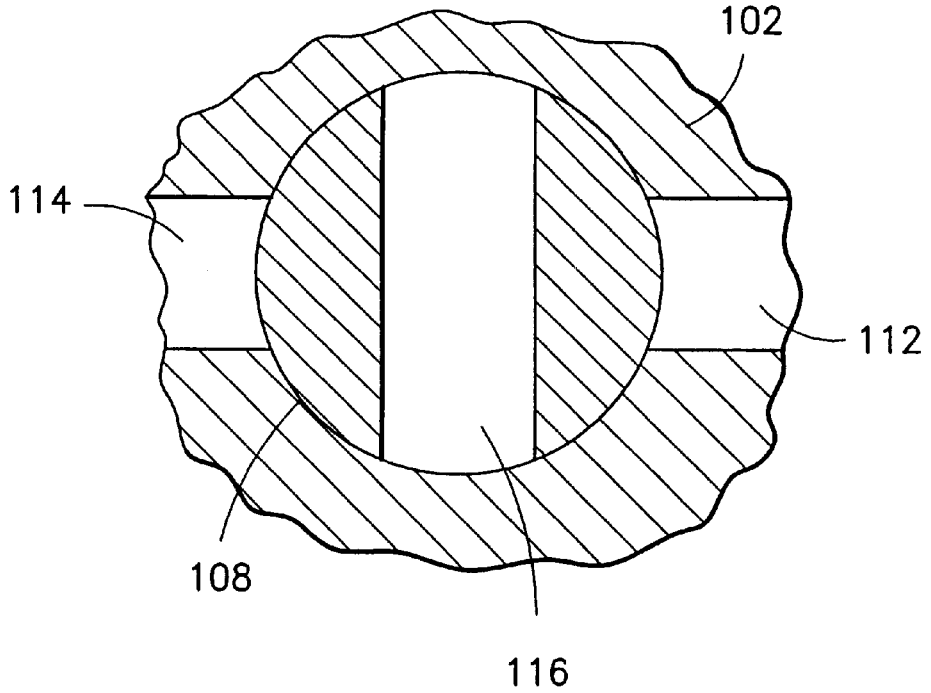
FIG. 7B is an enlarged cross-sectional view as in FIG. 7A with the shaft in a non-fuel/air enrichment position.

Referring now to FIG. 6 another alternate embodiment will be described. In this embodiment the carburetor 100 does not have a choke valve assembly. Instead, the carburetor 100 comprises a fuel enrichment system 102 for enriching fuel supply during cold starting of the engine. Any suitable type of fuel enrichment system can be used, such as disclosed in U.S. patent applications 60/133,286; 60/125,819; 60/125/648; 60/125,029; 09/065,374 and 09/138,244 which are hereby incorporated by reference in their entireties. In the embodiment shown, the carburetor 100 generally comprises a frame 102 with a venturi 104, a main air flow channel 106, and the throttle valve assembly 30. The fuel enrichment system 102 generally comprises a shaft 108, control member 110 connected to the shaft 108, and two conduits 112, 114. The first conduit 112 is connected to a fuel supply 46. Any suitable fuel supply could be used including one that pumps fuel into conduit 112. The second conduit 114 extends into the air flow channel 106 proximate the venturi 104. The shaft 108 extends into a joint between the two conduits 112, 114. Referring also to FIG. 7A, the shaft 108 comprises a hole 116. Rotation of the shaft 108 can rotate the hole 116 into and out of registration with the two conduits 112, 114. Thus, flow of fuel from the fuel supply 46, through the conduits 112, 114 and into the main air channel 106 can be controlled dependent upon the angular position of the shaft 108 and hole 116. Rotation of the shaft 108 can, thus, function as an ON/OFF fuel/air enrichment valve for flow of fuel through the conduits 112, 114. When the hole 116 is not aligned with the conduits 112, 114, as shown in FIG. 7B, the valve is in an OFF or non-fuel/air enrichment position (analogous or equivalent to a non-choke position) such that the fuel enrichment system is disabled to prevent pumping of extra fuel into the main air channel 106. The partial alignment of the hole 116 with the conduits 112, 114 would also provide fuel/air enrichment (equivalent to a partial choke position), but not as much as a full fuel/air enrichment position. Thus, as illustrated by this embodiment, features of the present invention are not limited to conventional choke systems, but could be used in other forms of fuel enrichment. The term "fuel/air enrichment" as used herein is intended to include choke systems or any other suitable type of fuel enrichment system such as described above. The term "fuel/air enrichment position" is intended to also mean a choke position. The term "non-fuel/air enrichment position" is also intended to include or mean a non-choke position. The term "fuel/air enrichment valve" is intended to also mean "choke valve."

The control member 110 has a shape such as disclosed with members 68 or 68' to interact with the member 56 as described above. In alternate embodiments the throttle valve assembly could be replaced with a similar rotatable shaft/hole configuration, such as with fuel injection or entrainment. The terms "throttle valve" and "throttle valve assembly" are also intended to include these types of injection/entrainment systems. Such a throttle fuel injection/entrainment system could also be used with a choke valve assembly.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the scope of the appended claims.

What is claimed is:

1. A carburetor control system for a carburetor, the carburetor comprising a fuel/air enrichment system and a throttle valve assembly, the control system comprising:

a first cam connected to the fuel/air enrichment system; and a second cam connected to the throttle valve assembly, wherein the second cam comprises a first section and a second section, wherein when the first cam is moved to a fuel/air enrichment position the first section can be contacted by the first cam to latch the second cam in a start position, and when the throttle valve assembly is moved to a wide open throttle position the second section can contact the first cam to hold the first cam in the fuel/air enrichment position.

2. A control system as in claim 1 wherein the first cam comprises an arm with two contact surfaces on opposite sides of the arm, each contact surface contacting respective ones of the first and second sections.

3. A control system as in claim 2 wherein a distal tip of the arm forms a latch surface for the first section of the second cam.

4. A control system as in claim 1 wherein the second cam comprises a space between the first and second sections, and wherein a portion of the first cam is movable in the space between the first and second sections.

5. A control system as in claim 1 wherein the first section comprises a first arm and the second section comprises a second arm.

6. A control system as in claim 5 wherein the second arm is shorter than the first arm.

7. A control system as in claim 5 wherein the first and second arms project from an axis of rotation of the second cam at about a 55° angle between the first and second arms.

8. A control system as in claim 1 wherein at least one of the cams is movable out of a plane of the other cam to pass between the other cam and a frame of the carburetor.

9. A control system as in claim 1 wherein the fuel/air enrichment system comprises a choke valve assembly and the fuel/air enrichment position comprises a choke position.

10. A carburetor comprising:

a housing;

a fuel/air enrichment valve connected to the housing;

a throttle valve connected to the housing; and a carburetor control system as in claim 1 connected to the fuel/air enrichment valve and the throttle valve.

11. In a carburetor control system for a carburetor, the carburetor comprising a fuel/air enrichment valve and a throttle valve, a throttle control being connected to the throttle valve, wherein the improvement comprises:

a positioning linkage between the fuel/air enrichment valve and the throttle valve, wherein when a user moves the fuel/air enrichment valve to a fuel/air enrichment position the linkage retains the fuel/air enrichment valve at the fuel/air enrichment position, and when the user subsequently moves the throttle control to move the throttle valve to a wide open throttle position, before the throttle valve is released to an idle position, the linkage also locates the fuel/air enrichment valve at the fuel/air enrichment position, wherein the linkage comprises at least two cam members which are separately movable relative to each other and can latch with each other, wherein at least one to the two cam members comprise two arms for contacting the other cam member, and further comprising a spring biasing the fuel/air enrichment valve in a predetermined position.

12. A carburetor control system for a carburetor which comprises a fuel/air enrichment valve and a throttle valve, the carburetor control system comprising;

a first control member connected to the fuel/air enrichment valve; and a second control member connected to the throttle valve, wherein the second control member comprises two spaced apart contact areas, wherein the first control member is movable relative to the second control member and, when the first control member is located at a fuel/air enrichment position for the fuel/air enrichment valve, the two spaced apart contact areas can make respective separate contact with the first control member in at least two different positions of the first control member corresponding to at least two different positions of the throttle valve.

13. A carburetor control system as in claim 12 wherein the second control member comprises an open space between the two spaced apart contact areas.

14. A carburetor control system as in claim 13 wherein the first control member is sized and shaped to move between the two spaced apart contact areas in the space.

15. A carburetor control system as in claim 12 wherein the first control member comprises an arm with two contact surfaces on opposite sides of the arm, each contact surface contacting respective ones of the two spaced apart contact areas.

16. A carburetor control system as in claim 15 wherein a distal tip of the arm forms a latch surface for one of the contact areas of the second control member.

17. A carburetor control system as in claim 12 wherein the two contact areas comprise a respective first arm and a respective second arm.

18. A carburetor control system as in claim 17 wherein the second arm is shorter than the first arm.

19. A power tool comprising a carburetor control system as in claim 17 wherein the first and second arms project from an axis of rotation of the second control member at about a 55° angle between the first and second arms.

20. A power tool comprising a carburetor control system as in claim 12 wherein the second control member further comprises a cam surface adjacent and orthogonal to one of the two spaced apart contact areas for contacting the first control member.

21. A power tool comprising:

a frame; and an internal combustion engine connected to the frame, the internal combustion engine comprising a carburetor having a carburetor control system as in claim 12.

22. A carburetor control system for a carburetor which comprises a housing, a fuel/air enrichment valve connected to the housing, and a throttle valve connected to the housing, the carburetor control system comprising:

a manually actuatable control connected to the fuel/air enrichment valve;

a first automatic control member connected to the fuel/air enrichment valve; and a second automatic control member connected to the throttle valve;

wherein, when a user manually moves the manually actuatable control to move the fuel/air enrichment valve to a fuel/air enrichment position, the first automatic control can contact the second automatic control member to move the throttle valve to a first open position, and wherein, when the user subsequently moves the throttle valve to a wide open throttle position, the second automatic control member contacts the first automatic control member to provide the fuel/air enrichment valve at the fuel/air enrichment position.

23. A carburetor comprising:

a housing;

a fuel/air enrichment valve connected to the housing;

a throttle valve connected to the housing; and a carburetor control system as in claim 22 connected to the fuel/air enrichment valve and the throttle valve.

* * * * *

UNITED STATES PATENT AND TRADEMARK OFFICE

CERTIFICATE OF CORRECTION

PATENT NO. : 6,494,439 B1
DATED : December 17, 2002
INVENTOR(S) : Imack L. Collins It is certified that error appears in the above-identified patent and that said Letters Patent is hereby corrected as shown below:

Column 9,
Line 42, delete “to” and replace with -- of --.

Signed and Sealed this

Twenty-fourth Day of February, 2004

JON W. DUDAS
*Acting Director of the United States Patent and Trademark Office*